US012203357B2

(12) United States Patent
Dunbar et al.

(10) Patent No.: US 12,203,357 B2
(45) Date of Patent: Jan. 21, 2025

(54) SYSTEMS AND METHODS FOR DRILLING A BOREHOLE USING DEPTH OF CUT MEASUREMENTS

(71) Applicant: Halliburton Energy Services, Inc., Houston, TX (US)

(72) Inventors: Bradley D. Dunbar, The Woodlands, TX (US); John L. Wisinger, Jr., Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/250,477

(22) PCT Filed: Oct. 23, 2018

(86) PCT No.: PCT/US2018/057123

§ 371 (c)(1),
(2) Date: Jan. 26, 2021

(87) PCT Pub. No.: WO2020/086064

PCT Pub. Date: Apr. 30, 2020

(65) Prior Publication Data

US 2021/0301641 A1 Sep. 30, 2021

(51) Int. Cl.

| | |
|---|---|
| ***E21B 10/42*** | (2006.01) |
| ***E21B 44/02*** | (2006.01) |
| ***E21B 45/00*** | (2006.01) |
| ***E21B 47/08*** | (2012.01) |
| ***E21B 47/09*** | (2012.01) |
| *E21B 47/12* | (2012.01) |

(52) U.S. Cl.
CPC ..... *E21B 44/02* (2013.01); *E21B 10/42* (2013.01); *E21B 45/00* (2013.01); *E21B 47/08* (2013.01); *E21B 47/09* (2013.01); *E21B 47/12* (2013.01)

(58) Field of Classification Search
CPC ..... E21B 44/02; E21B 45/00; E21B 47/08
See application file for complete search history.

(56) References Cited

U.S. PATENT DOCUMENTS

| | | | | |
|---|---|---|---|---|
| 5,012,453 A * | 4/1991 | Katz | G01V 1/28 702/9 |
| 5,148,407 A * | 9/1992 | Haldorsen | G01V 1/20 367/32 |
| 5,469,736 A | 11/1995 | Moake | |
| 5,899,958 A | 5/1999 | Dowell et al. | |
| 6,151,554 A * | 11/2000 | Rodney | G01V 1/42 702/9 |
| 7,946,357 B2 | 5/2011 | Trinh | |
| 9,238,958 B2 | 1/2016 | Teodorescu | |

(Continued)

OTHER PUBLICATIONS

International Search Report and Written Opinion dated Jul. 19, 2019 for PCT Application No. PCT/US2018/057123 filed Oct. 23, 2018. 12 pgs.

*Primary Examiner* — Blake Michener
(74) *Attorney, Agent, or Firm* — K&L Gates LLP

(57) ABSTRACT

A drill bit for a drilling system. The drill bit may include blades and a first depth of cut sensor. The blades may each comprise cutters. The first depth of cut sensor may be coupled to one of the blades and positioned to measure a distance between the first depth of cut sensor and a downhole surface of the borehole and transmit the distance measurement to a control system of the drilling system.

18 Claims, 4 Drawing Sheets

(56) References Cited

U.S. PATENT DOCUMENTS

| | | | | |
|---|---|---|---|---|
| 9,540,928 | B2 | 1/2017 | Zhou | |
| 9,631,483 | B2 | 4/2017 | Donderici et al. | |
| 10,233,698 | B2 * | 3/2019 | Humphrey | E21B 10/56 |
| 10,281,607 | B2 | 5/2019 | Hori et al. | |
| 2004/0073370 | A1 * | 4/2004 | Dasgupta | G01V 1/42 702/6 |
| 2007/0186639 | A1 | 8/2007 | Spross | |
| 2008/0312839 | A1 * | 12/2008 | Mathiszik | G01V 1/50 702/11 |
| 2010/0089645 | A1 | 4/2010 | Trinh | |
| 2011/0060527 | A1 | 3/2011 | Teodorescu | |
| 2011/0153296 | A1 | 6/2011 | Sadlier | |
| 2015/0218935 | A1 * | 8/2015 | Pelletier | E21B 12/02 175/327 |
| 2015/0275648 | A1 | 10/2015 | Wang | |
| 2015/0322720 | A1 | 11/2015 | Pelletier | |
| 2018/0163527 | A1 * | 6/2018 | Curry | E21B 45/00 |
| 2020/0271809 | A1 * | 8/2020 | Al-Ali | G01V 1/50 |
| 2021/0372258 | A1 * | 12/2021 | Kazemi Nojadeh | G01V 1/46 |

* cited by examiner

SYSTEMS AND METHODS FOR DRILLING A BOREHOLE USING DEPTH OF CUT MEASUREMENTS

BACKGROUND

This section is intended to provide relevant background information to facilitate a better understanding of the various aspects of the described embodiments. Accordingly, it should be understood that these statements are to be read in this light and not as admissions of prior art.

Various types of tools are used to form boreholes in subterranean formations for recovering hydrocarbons such as oil and gas lying beneath the surface. Examples of such tools include rotary drill bits, hole openers, reamers, and coring bits. Rotary drill bits include, but are not limited to, fixed cutter drill bits, drag bits, matrix drill bits, rock bits, and roller cone drill bits.

In a drilling application, a drill bit may be selected based on the properties of the formation being drilled through. As the borehole is formed, a depth of cut, the amount of formation material that is removed by the drill bit in each revolution, is measured and a rate of penetration, the speed at which the borehole is deepened, is determined based on this measurement.

Currently, depth of cut measurements are calculated based on a measured rate of penetration or physically measured downhole as the formation is being drilled. The rate of penetration can be calculated at the surface or through the use of downhole sensors. However, both of these methods provide an average depth of cut and, therefore, cannot provide real-time depth of cut measurements. Further, the drill string may act as a spring due to the forces applied to the drill string, introducing a potential source of error when measuring the rate of penetration. Additionally, although physical measurement systems integrated into a drill bit do exist and may provide a real-time depth of cut measurement, the systems utilize springs which can deform over time, leading to inaccurate measurements, or fail, leading to costly downtime as the spring is replaced.

Accordingly, there exists a need for an improved system and method for measuring depth of cut of a drill bit to provide a more accurate rate of penetration through a formation.

BRIEF DESCRIPTION OF THE DRAWINGS

Embodiments of the system for drilling a borehole are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure provides systems and methods for drilling a borehole using depth of cut measurements. The systems and methods may be used to determine depth of cut of a drill bit as the borehole is being drilled.

A main borehole may in some instances be formed in a substantially vertical orientation relative to a surface of the well, and a lateral borehole may in some instances be formed in a substantially horizontal orientation relative to the surface of the well. However, reference herein to either the main borehole or the lateral borehole is not meant to imply any particular orientation, and the orientation of each of these boreholes may include portions that are vertical, non-vertical, horizontal or non-horizontal. Further, the term "uphole" refers a direction that is towards the surface of the well, while the term "downhole" refers a direction that is away from the surface of the well.

Figure 1:
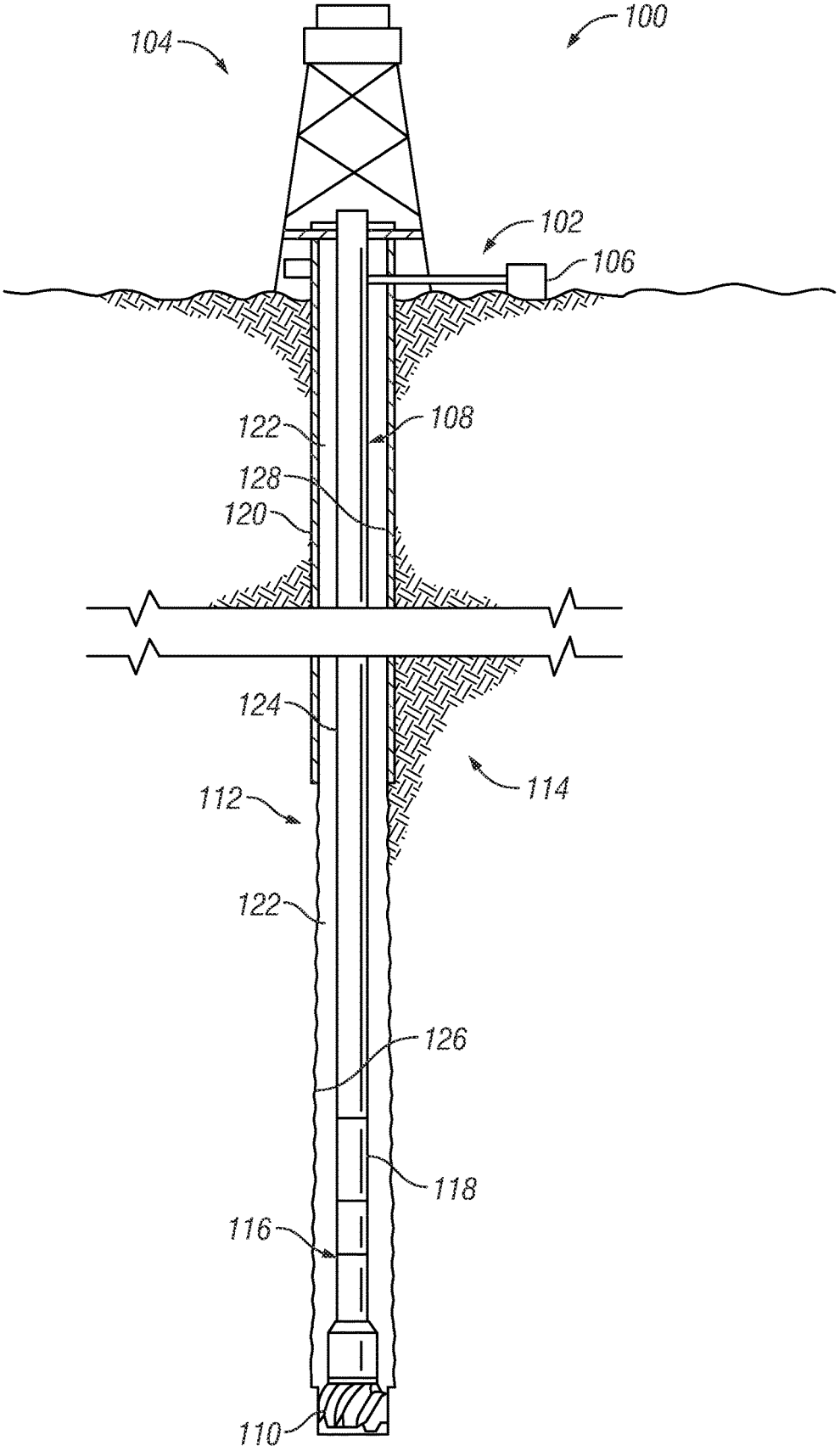
FIG. 1 is a cross-sectional diagram of a drillings system.

FIG. 1 is a cross-sectional diagram of a drilling system 100, according to one or more embodiments disclosed. The drilling system 100 is located at well site 102. The drilling system 100 includes a drilling rig 104 as well as a control system 106. Various types of drilling equipment such as generators, a rotary table, fluid pumps, and drilling fluid tanks (not shown) may also be located at the well site 102. Although a land drilling system 100 is shown, the features of the drilling system 100 discussed below may also be used with offshore drilling systems (not shown).

Drilling system 100 also includes a drill string 108 coupled to a drill bit 110 used to form a borehole 112 in a formation 114. A bottom hole assembly ("BHA") 116 include a wide variety of components configured to form the borehole 112. For example, components of the BHA 116 may include, but are not limited to, drill bits, such as the drill bit 110, coring bits, drill collars, rotary steering tools, directional drilling tools, downhole drilling motors, a gear box, reamers, and hole enlargers or stabilizers. The number and types of components included in the BHA 116 depends on anticipated downhole drilling conditions and the type of borehole 112 that will be formed by the drill string 108 and the drill bit 110.

The BHA 116 includes a control system 118. The BHA may also include various types of well logging tools, measurement-while-drilling tools, telemetry systems, and other downhole tools associated with drilling a borehole 112. Examples of logging tools may include, but are not limited to, acoustic, neutron, gamma ray, density, photoelectric, nuclear magnetic resonance, rotary steering tools and/or any other commercially available well tool. Further, the BHA 116 may also include a rotary drive connected to the components of the BHA 116 that rotates at least part of the drill string 108 together with the components of the BHA 116 and/or the BHA 116 may not include a control system.

The borehole 112 is defined in part by a casing 120 that extends from the well site 102 to a selected downhole location. Portions of the borehole 112 below the selected location, however, may not include casing. In other embodiments, casing may extend the length of the borehole 112. Various types of drilling fluid may be pumped from the well site 102 through the drill string 108 and the drill bit 110. The drilling fluid is circulated back to the well site 102 through an annulus 122 defined in part by an outside diameter 124 of the drill string 108 and an inside diameter 126 of the borehole 112, also referred to as the sidewall of the borehole 112. The annulus 122 may also be defined by an outside diameter 124 of the drill string 108 and an inside diameter 128 of the casing 120.

Figure 2:
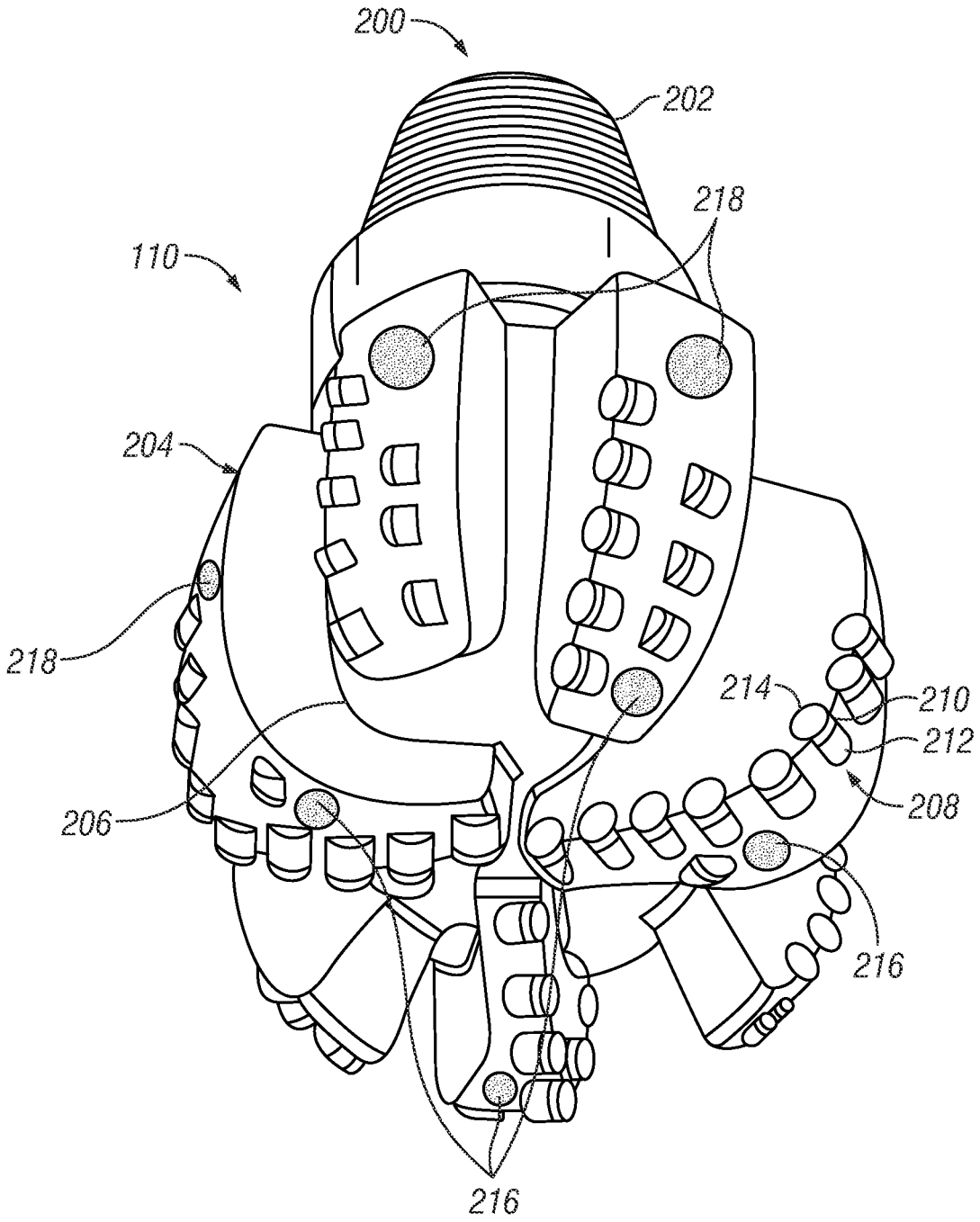
FIG. 2 is an isometric view of the drill bit of the drilling system of FIG. 1.

FIG. 2 illustrates an isometric view of the drill bit 110 of the drilling system 100 shown in FIG. 1. The drill bit 110 may be any of various types of fixed cutter drill bits, including PCD bits, drag bits, matrix drill bits, and/or steel body drill bits operable to form a borehole extending through one or more downhole formations. The uphole end 200 of the drill bit 110 includes a threaded shank 202. The threaded shank 202 is used to releasably engage the drill bit 110 with the BHA 116, allowing the drill bit 110 to rotate along with the BHA 116. As previously discussed, the BHA 116 may include a gearbox that allows the drill bit 110 to rotate at a different speed than the remainder of the BHA 116.

A drill bit may conceivably include any number of blades circumferentially spaced about a bit body. In the example of FIG. 2, the drill bit 110 includes a plurality of blades 204 that are disposed outwardly from a bit body 206 of the drill bit 110. The blades 204 may be coupled to the bit body 206 or alternatively may be formed from the bit body 206. Each blade 204 includes a plurality of cutters 208 disposed outwardly from the blade 204. The cutters 208 are optionally arranged in this example in a plurality of rows per blade, wherein one row of cutters may be configured as primary cutters, and subsequent rows may be configured as backup cutters, secondary cutters or any combination thereof.

Each cutter 208 includes a super-hard cutting layer 210 such as diamond, disposed on a substrate 212, such as tungsten carbide (WC). The cutting layer 210 includes a cutting face 214 that engages the formation 114 to form the borehole 112, such as by a shearing, gouging, scraping, or combination thereof, depending on the particular bit and cutter type and configuration. The substrate 212 may have any of a variety of configurations, typically a cylindrical shape as shown, and may be formed from tungsten carbide or other suitable materials associated with forming cutters for rotary drill bits. The cutting layer 210 in the illustrated configuration is typically formed from polycrystalline diamond (PCD) material, such as a thermally stable polycrystalline diamond (TSP), or other suitable materials. Although the drill bit in 200 in FIG. 2 is illustrated as a fixed-cutter type bit, it should be understood that the aspects of this disclosure may be applied to other types of drill bits having a plurality of cutters arranged about a bit body, such as abrasive drill bits or roller cone bits, and that alternate configurations of cutters including abrasive type cutters may be included. These aspects may also be applied to other rotary cutting tools having a cutting structure disposed on its periphery, such as coring bits or reamers.

The drill bit 110 also includes one or more depth of cut sensors (four shown, 216) that are coupled to the blades 204 and do not extend beyond the cutters 208 on the blade 204. This prevents the depth of cut sensors 216 from contacting the formation 114 as the cutters 208 engage the formation 114. The depth of cut sensors 216 are positioned to measure the distance between the respective depth of cut sensors 216 and the downhole surface of the borehole 112, as described in more detail below. A single or multiple depth of cut sensors 216 may be coupled to a single blade 204 or alternatively each blade 204 may include a single or multiple depth of cut sensors 216, or both. Additionally, the depth of cut sensors 216 may be coupled to the bit body 206 between the blades.

In the illustrated embodiment, the depth of cut sensors 216 are acoustic sensors that reflect acoustic signals off of a surface to determine a distance between the surface and the acoustic sensor. Additional types of sensors, such as resistivity sensors or optical sensors, may be used in addition to or in place of the acoustic sensors, however performance of the depth of cut sensors 216 may vary depending on the type of sensor that is used.

In addition to the depth of cut sensors 216, one or more lateral sensors 218 (three shown) are be coupled to the blades 204 of the drill bit 110. Similar to the depth of cut sensors 216, the lateral sensors 218 do not extend beyond the cutters 208 on the blade 204 to prevent the lateral sensors 218 from contacting the formation 114. The lateral sensors 218 are positioned to measure the distance between the respective lateral sensor 218 and the sidewall of the borehole 112. A single or multiple lateral sensors 218 are coupled to a single blade 204 of the drill bit 110 or alternatively each blade 204 may include a single or multiple lateral sensors 218, or both. Additionally, lateral sensors 218 may be coupled to the bit body 206 between the blades.

In the illustrated embodiment, the lateral sensors 218 are acoustic sensors that reflect acoustic signals off of a surface to determine a distance between the surface and the acoustic sensor. Additional types of sensors, such as resistivity sensors or optical sensors, may be used in addition to or in place of the acoustic sensors, however performance of the lateral sensors 218 may vary depending on the type of sensor that is used. Further, some drill bits 110 may not include lateral sensors.

Figure 3:
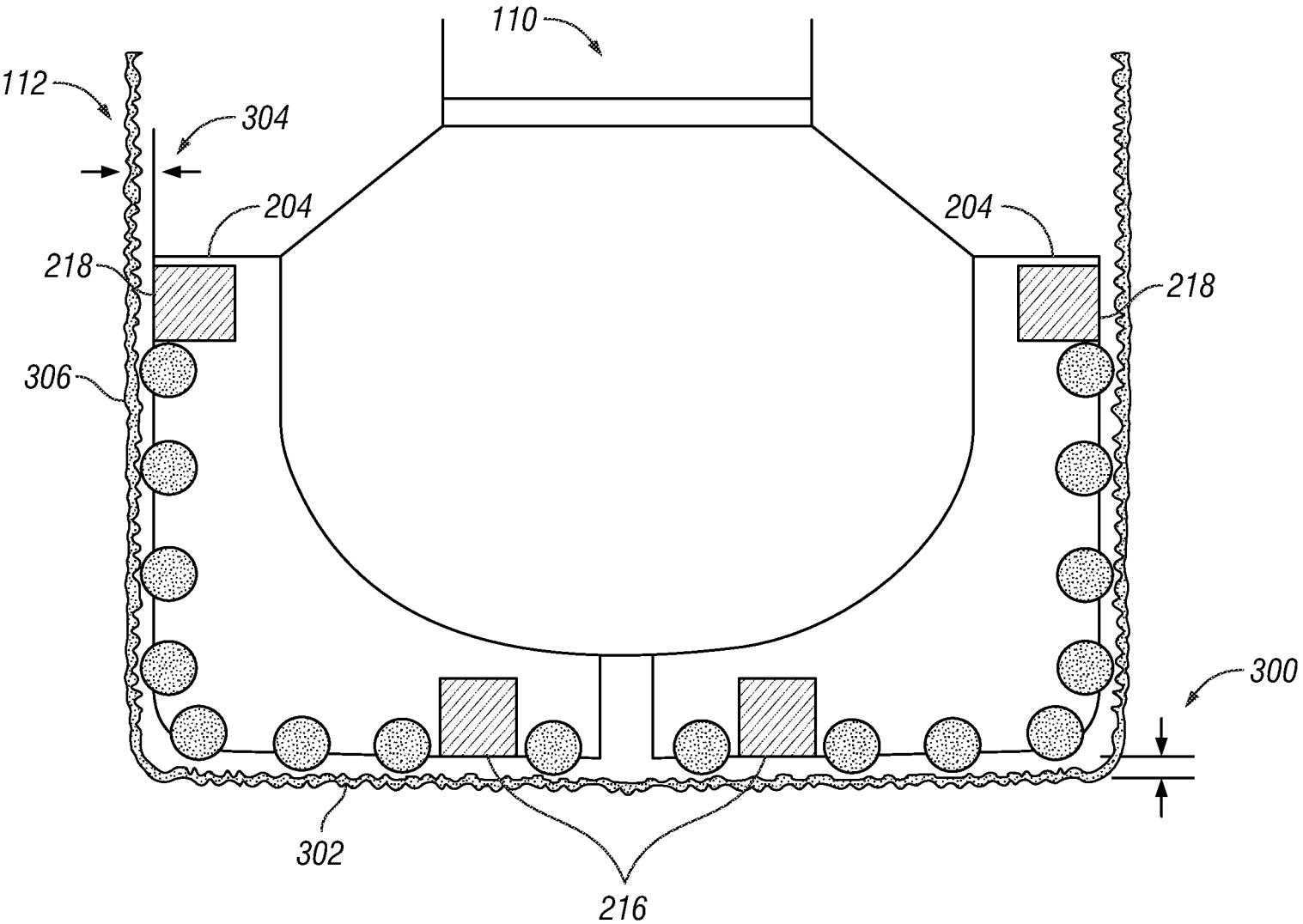
FIG. 3 is a cross-sectional diagram of the drill bit of FIG. 1 in a lower portion of the borehole of FIG. 1.

FIG. 3 is cross-sectional diagram of the drill bit of FIG. 1 in a lower portion of the borehole 112. As shown in FIGS. 1 and 3, the cutters 208 of the drill bit 110 engage with formation 114. As the drill bit 110 is rotated by the BHA 116, the cutters 208 remove material from the formation 114, forming the borehole 112. Additionally, accelerometers (not shown), magnetometers (not shown), and/or gyroscopes (not shown) in the BHA 116 are used to determine when a revolution of the drill bit 110 has occurred.

At least once per rotation of the drill bit, one or more depth of cut sensors 216 measure the distance 300 between the depth of cut sensor 216 and the downhole surface 302 of the borehole 112 in real time. The surface control system 106, a control system 118 in the BHA 116, or both are used to calculate the difference between an initial distance measurement taken by the depth of cut sensor 216 and a distance measurement taken by the depth of cut sensor 216 after a single revolution of the drill bit 110 to determine an average depth of cut of the drill bit 110.

When utilizing a surface control system 106, the measurements from the depth of cut sensors 216 are sent uphole to the surface control system 106 through a telemetry system (not shown). In other embodiments, the downhole control system 118 may be used to calculate the average depth of cut of the drill bit 110. The depth of cut sensors 216 may also take measurements more than once per revolution of the drill bit. The measurements may also be taken more often than once per revolution and the incremental depth of cut measurements can be summed and averaged by the control system 106, 118 to provide a more accurate average depth of cut measurement. When using multiple depth of cut sensors 216, the measurements made by each sensor may also be averaged when determining the average depth of cut. Multiple depth of cut sensors 216 may also be used in conjunction with lateral sensors 218, accelerometers, and/or magnetometers to determine the depth of cut in a specific location of the borehole.

Once the average depth of cut of the drill bit 110 is determined, the rate of penetration of the drill bit 110 can be calculated by multiplying the average depth of cut by the rotational speed of the drill bit 110. Similar to the average depth of cut determination, this may be done using the surface control system 106, a control system 118 in the BHA 116, or both. When using a surface control system 106, only the measurements are sent uphole, as previously described, or a control system 118 in the BHA 116 may determine the rate of penetration and send the rate of penetration uphole via the telemetry system. In at least one embodiment, the depth of cut sensor measurements and/or calculated rate of penetration may be stored by the control system 106, 118 for later retrieval.

One or more lateral sensors 218 are used to measure the distance 304 between the lateral sensor 218 and the sidewall 306 of the borehole 112 to determine the position of the drill bit 110 within the borehole 112 and/or to map the shape of the borehole 112. Similar to the measurements from the depth of cut sensors 216, the measurements from the lateral sensors 218 are utilized by the surface control system 106, a control system 116 in the BHA 116, or both. In at least one embodiment, the measurements from a single lateral sensor 218 may be used by the control system 106, 118 in conjunction with the accelerometers, magnetometers, and/or gyroscopes in the BHA 116. Measurements from multiple lateral sensors 218 may also be used by the control system 106, 118 to determine the position of the drill bit 110 within the borehole 112 and to map the shape of the borehole 112. The lateral measurements, position information, and/or borehole shape information may also be stored by the control system 106, 118 for later retrieval.

Figure 4:
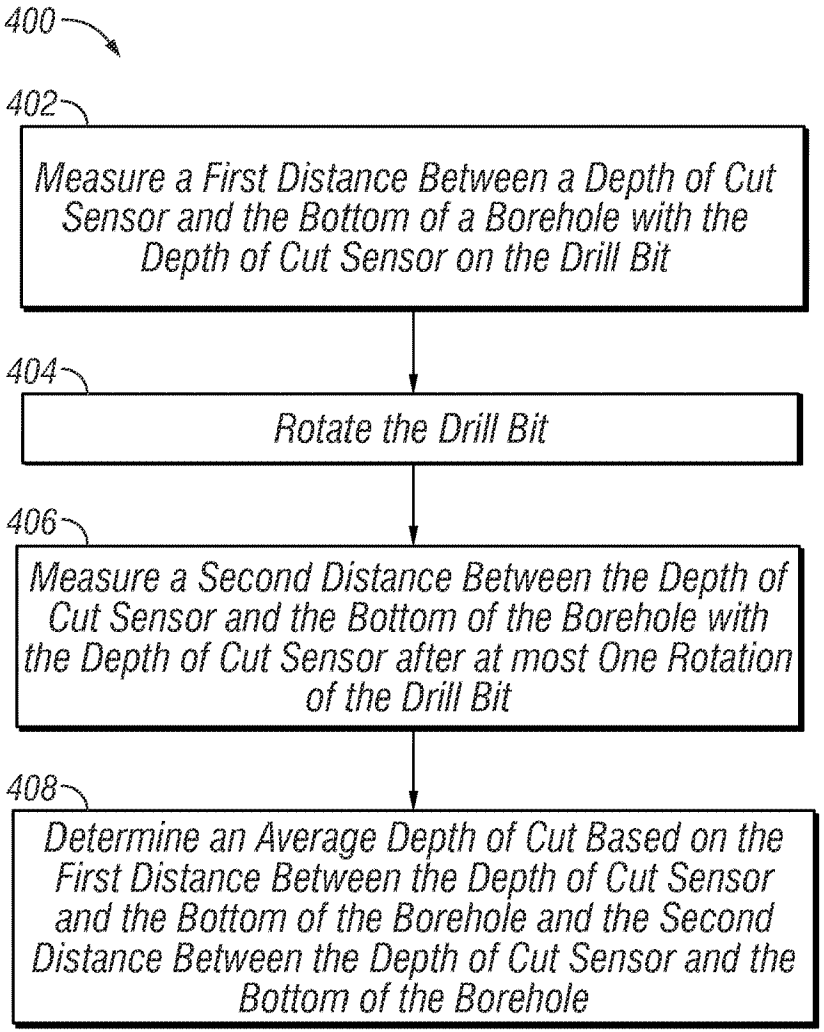
FIG. 4 is a flow chart illustrating a method of drilling a borehole.

FIG. 4 is a flow chart illustrating a method 400 of drilling a borehole, according to one or more embodiment disclosed. In step 402, a first distance between a depth of cut sensor and the bottom of a borehole is measured with the depth of cut sensor. In step 404, the drill bit is rotated. In step 406, a second distance between the depth of cut sensor and the bottom of the borehole is measured with the depth of cut sensor after at most one rotation of the drill bit. In step 408, an average depth of cut is determined based on the first distance between the depth of cut sensor and the bottom of the borehole and the second distance between the depth of cut sensor and the bottom of the borehole.

The depth of cut measurements taken using the method of FIG. 4 may be used to determine if the cutters on the drill bit need to be replaced. As the drill bit forms a borehole in the formation, the cutters are engaged with the formation, causing wear on the cutters, which reduces the size of the cutters over time. This reduction in size will also reduce the depth of cut per revolution of the drill bit and, therefore can be tracked by evaluating the change in the average depth of cut over time. Additionally, once a minimum depth of cut is reached, it may indicate that the cutters or the drill bit itself need to be replaced.

The method of FIG. 4 or a similar method may also be used to calculate a rate of penetration of the drill bit based on the average depth of cut and a rotational speed of the drill bit, which can be determined using lateral sensors, accelerometers, magnetometers, and/or gyroscopes. Once the rate of penetration is known, it can be evaluated against a predicted rate of penetration. If the actual rate of penetration is lower than the predicted rate of penetration, an operator can evaluate if stick slip, forward whirl, backward whirl, lateral vibration, or other types of drilling dysfunction are occurring.

If it is determined that a drilling dysfunction is occurring, the rotational speed of the drill bit and/or a weight applied to the drill bit can be adjusted as necessary to increase the rate of penetration of the drill bit. As non-limiting examples, a stick slip drilling dysfunction may require an increase in the rotational speed of the drill bit and/or a decrease in the weight applied to the drill bit, and a backward whirl drilling dysfunction may require a reduction in the rotational speed of the drill bit and/or an increase in the weight applied to the drill bit. Additional types of drilling dysfunctions may require different adjustments to the rotational speed of the drill bit or the weight applied to the drill bit.

Figure 5:
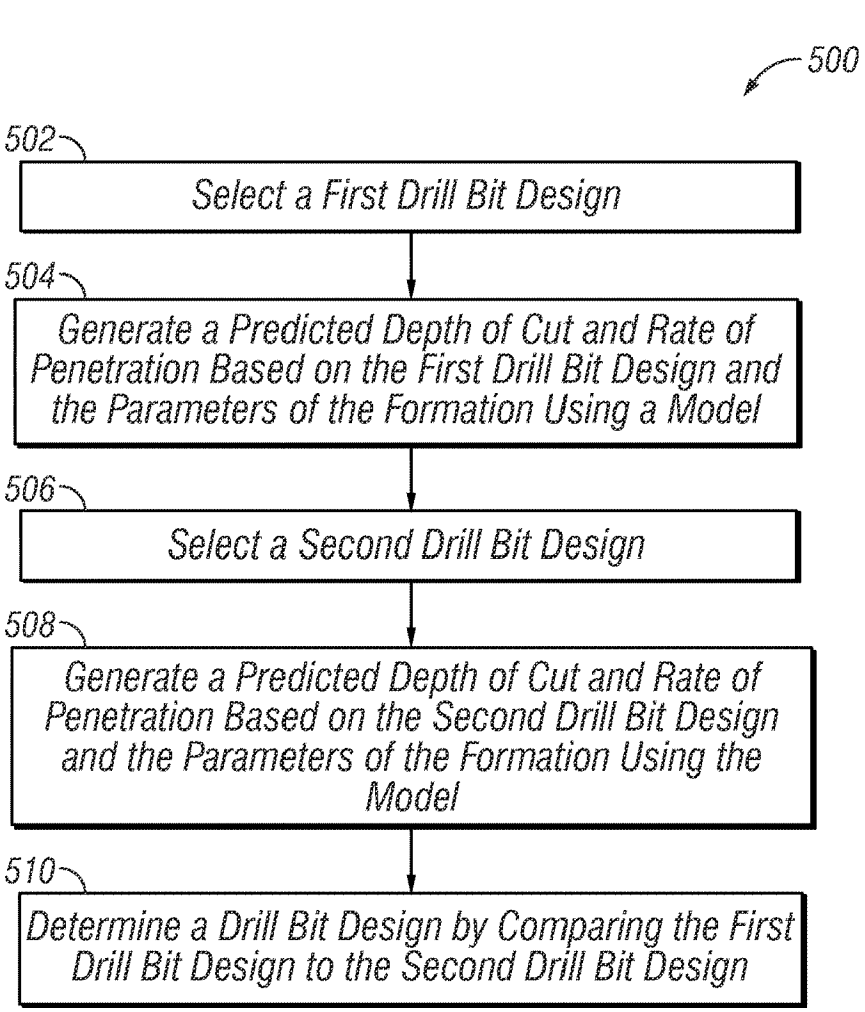
FIG. 5 is a flow chart illustrating a method of selecting a drill bit design for a given formation using a computer model.

FIG. 5 is a flow chart 500 illustrating a method of selecting a drill bit design for a given formation using a computer model that simulates drilling a borehole through a formation having a given set of parameters. As shown in 502, a drill bit design is selected. The model then generates a predicted depth of cut and rate of penetration based on the design of the drill bit and the parameters of the formation, as shown in 504. The model also generates additional information. A second drill bit design is then selected, as shown in 506, and the model then generates a predicted depth of cut and rate of penetration based on the design of the drill bit and the parameters of the formation, as shown in 508. The predicted depth of cut and predicted rate of penetration are compared to determine which drill bit to use for the given formation, as shown in 510. The model may also compare three, four, or more drill bit designs. Additionally, the model may be used to determine a drilling plan for the formation once a drill bit is selected.

The depth of cut measurements that are taken using the method of FIG. 4 or similar methods may also be used to verify or revise the computer model. Once a drill bit and drilling plan are selected, the actual average depth of cut and actual rate of penetration measurements are used to verify the computer model. The actual average depth of cut and rate of penetration may also be used revise the computer model to increase the accuracy of the predicted rate of penetration and depth of cut, adjust an existing drilling plan, and/or improve future drilling plans that are determined using the model.

Certain embodiments of the disclosed invention may include a drill bit for a drilling system. The drill bit may include blades and a first depth of cut sensor. The blades may each comprise cutters. The first depth of cut sensor may be coupled to one of the blades and positioned to measure a distance between the first depth of cut sensor and a downhole surface of the borehole and transmit the distance measurement to a control system of the drilling system.

In certain embodiments, the drill bit may also include a second depth of cut sensor positioned to measure a distance between the second depth of cut sensor and the downhole surface of the borehole and transmit the distance measurement to the control system.

In certain embodiments, the second depth of cut sensor may be coupled to a different one of the blades than the first depth of cut sensor.

In certain embodiments, the drill bit may also include a first lateral sensor coupled to one of the blades. The first lateral sensor may be positioned to measure a radial distance between the first lateral sensor and a borehole wall and transmit the distance measurement to the control system.

In certain embodiments, the drill bit may also include a second lateral sensor positioned to measure a radial distance between the second lateral sensor and the borehole wall and transmit the distance measurement to the control system.

In certain embodiments, the second lateral sensor may be coupled to a different one of the blades than the first lateral sensor.

Certain embodiments of the disclosed invention may include a system for drilling a borehole. The system may include a drill string, a drill bit operatively coupled to the drill string, and a control system. The drill string may be configured to rotate within a borehole. The drill bit may include blades and a first depth of cut sensor. The blades may each comprise cutters. The first depth of cut sensor may be coupled to one of the blades and positioned to measure a distance between the first depth of cut sensor and a downhole surface of the borehole. The control system may be configured to receive the measurements from the first depth of cut sensor and control a rotational speed of the drill bit and a force on the drill bit.

In certain embodiments, the drill bit may also include a second depth of cut sensor positioned to measure a distance between the second depth of cut sensor and the downhole surface of the borehole and transmit the distance measurement to the control system.

In certain embodiments, the drill bit may also include a first lateral sensor coupled to one of the blades. The first lateral sensor may be positioned to measure a radial distance between the first lateral sensor and a borehole wall and transmit the distance measurement to the control system.

In certain embodiments, the drill bit may also include a second lateral sensor positioned to measure a radial distance between the second lateral sensor and the borehole wall and transmit the distance measurement to the control system.

In certain embodiments, the control system may be further configured to calculate a rate of penetration based on measurements from the first depth of cut sensor.

In certain embodiments, the system may also include a telemetry system in communication with the surface control system.

In certain embodiments, the control system may include at least one of a surface control system and a control system locatable downhole.

Certain embodiments of the disclosed invention may include a method for drilling a borehole. The method may include measuring a first distance between a depth of cut sensor coupled to a drill bit of a drill string and the bottom of a borehole with the depth of cut sensor. The method may further include rotating the drill bit. The method may also include measuring a second distance between the depth of cut sensor and the bottom of the borehole with the depth of cut sensor after at most one rotation of the drill bit. The method may further include determining an average depth of cut based on the first distance between the depth of cut sensor and the bottom of the borehole and the second distance between the depth of cut sensor and the bottom of the borehole.

In certain embodiments, the method may also include taking a measurement of the distance between a lateral sensor coupled to the drill bit and a borehole wall with the lateral sensor.

In certain embodiments, the method may also include determining a dimension of the borehole based on the distance between the lateral sensor and the borehole wall.

In certain embodiments, the method may also include determining a position of the drill bit within the borehole based on the distance between the lateral sensor and a borehole wall.

In certain embodiments, the method may also include calculating a rate of penetration of the drill bit with a control system based on the average depth of cut and a rotational speed of the drill bit.

In certain embodiments, the method may also include adjusting the rotational speed of the drill bit via the control system based on the calculated rate of penetration.

In certain embodiments, the method may also include adjusting a force on the drill bit via the control system based on the calculated rate of penetration.

In certain embodiments, the control system may be located on the surface and the method may also include transmitting the measurements taken by the depth of cut sensor to the control system with a telemetry system.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A drill bit for a drilling system for drilling a borehole, the drill bit comprising:

blades further comprising cutters; and one or more acoustic depth of cut sensors located on the blades and oriented toward a bottom of the borehole, wherein the one or more acoustic depth of cut sensors are operable to measure multiple distances between the acoustic depth of cut sensors and the bottom of the borehole by transmitting acoustic signals to the bottom of the borehole, reflecting the acoustic signals off the bottom of the borehole, and receiving the acoustic signals reflected from the bottom of the borehole and are also operable to transmit the multiple distance measurements to a control system of the drilling system.

2. The drill bit of claim 1, further comprising a second acoustic depth of cut sensor located on a different one of the blades than the first acoustic depth of cut sensor and positioned to measure a second distance between the second acoustic depth of cut sensor and the bottom of the borehole by reflecting a second acoustic signal off the bottom of the borehole and transmitting the second distance measurement to the control system.

3. The drill bit of claim 1, further comprising a first lateral sensor located on one of the blades, the first lateral sensor positioned to measure a first radial distance between the first lateral sensor and a borehole wall and transmit the first radial distance measurement to the control system.

4. The drill bit of claim 3, further comprising a second lateral sensor located on a different one of the blades than the first lateral sensor and positioned to measure a second radial distance between the second lateral sensor and the borehole wall and transmit the second radial distance measurement to the control system.

5. A system for drilling a borehole, the system comprising:

a drill string configured to rotate within a borehole;

a drill bit operatively coupled to the drill string, the drill bit comprising:

blades further comprising cutters, and one or more acoustic depth of cut sensors located on the blades, the acoustic depth of cut sensors positioned to measure multiple distances between the acoustic depth of cut sensors and a bottom of the borehole by reflecting acoustic signals off the bottom of the borehole; and a control system configured to receive the multiple distance measurements from the acoustic depth of cut sensors and control a rotational speed of the drill bit and a force on the drill bit.

6. The system of claim 5, further comprising a second acoustic depth of cut sensor located on a different one of the blades than the first acoustic depth of cut sensor and positioned to measure a second distance between the second acoustic depth of cut sensor and the bottom of the borehole by reflecting a second acoustic signal off the bottom of the borehole and transmitting the second distance measurement to the control system.

7. The system of claim 5, further comprising a first lateral sensor located on one of the blades, the first lateral sensor positioned to measure a first radial distance between the first lateral sensor and a borehole wall and transmit the first radial distance measurement to the control system.

8. The system of claim 7, further comprising a second lateral sensor located on a different one of the blades than the first lateral sensor and positioned to measure a second radial distance between the second lateral sensor and the borehole wall and transmit the second radial distance measurement to the control system.

9. The system of claim 5, wherein the control system is further configured to calculate a rate of penetration based on the first distance measurements from the first acoustic depth of cut sensor.

10. The system of claim 9, further comprising a telemetry system in communication with the control system.

11. The system of claim 5, wherein the control system comprises at least one of a surface control system or a control system locatable downhole.

12. A method for drilling a borehole, the method comprising:

measuring multiple distances between acoustic depth of cut sensors located on a plurality of blades of a drill bit of a drill string oriented toward a bottom of the borehole and the bottom of a borehole with the acoustic depth of cut sensors by reflecting acoustic signals off the bottom of the borehole;

rotating the drill bit;

measuring a second multiple distances between the acoustic depth of cut sensors and the bottom of the borehole with the acoustic depth of cut sensors by reflecting second acoustic signals off the bottom of the borehole after at most one rotation of the drill bit;

receiving, at a control system, the distance measurements from the acoustic depth of cut sensors;

determining an average depth of cut based on the first distance between the acoustic depth of cut sensors and the bottom of the borehole and the second distance between the acoustic depth of cut sensors and the bottom of the borehole;

calculating a rate of penetration of the drill bit with the control system based on the average depth of cut and the rotational speed of the drill bit; and controlling, using the control system, a rotational speed of the drill bit and a force on the drill bit based on the calculated rate of penetration.

13. The method of claim 12, further comprising taking a measurement of the distance between a lateral sensor located on one of the blades of the drill bit and a borehole wall with the lateral sensor.

14. The method of claim 13, further comprising determining a dimension of the borehole based on the distance between the lateral sensor and the borehole wall.

15. The method of claim 13, further comprising determining a position of the drill bit within the borehole based on the distance between the lateral sensor and the borehole wall.

16. The method of claim 12, further comprising adjusting the rotational speed of the drill bit via the control system based on the calculated rate of penetration.

17. The method of claim 12, further comprising adjusting a force on the drill bit via the control system based on the calculated rate of penetration.

18. The method of claim 12, wherein the control system is located on the surface and the method further comprises transmitting the measurements taken by the acoustic depth of cut sensors to the control system with a telemetry system.

* * * * *